United States Patent [19]

Yunick

[11] Patent Number: 5,070,831

[45] Date of Patent: Dec. 10, 1991

[54] OIL CHANGE SYSTEM AND METHOD

[76] Inventor: Smokey Yunick, 957 N. Beach St., Daytona Beach, Fla. 32017

[21] Appl. No.: 659,992

[22] Filed: Feb. 22, 1991

[51] Int. Cl.[5] ..... F01M 11/04

[52] U.S. Cl. ..... 123/196 A; 123/196 S; 184/6.3

[58] Field of Search ..... 123/196 S, 196 A, 196 R; 184/6.3

[56] References Cited

U.S. PATENT DOCUMENTS

| | | | |
|---|---|---|---|
| 3,682,308 | 8/1972 | Moon | 210/136 |
| 4,094,293 | 6/1978 | Evans | 123/196 S |
| 4,359,140 | 11/1982 | Shreve | 184/6.3 |
| 4,433,656 | 2/1984 | Norwood, Sr. | 123/196 A |
| 4,479,468 | 10/1984 | Norwood, Sr. | 123/196 S |
| 4,524,733 | 6/1985 | Schmidt | 123/196 A |
| 4,672,932 | 6/1987 | Schmidt | 123/196 A |
| 4,703,727 | 11/1987 | Cannon | 123/196 S |
| 4,825,826 | 5/1989 | Andres | 123/196 S |
| 4,875,551 | 10/1989 | Lulich | 184/6.3 |
| 4,909,205 | 3/1990 | Bewley III | 123/196 S |
| 4,915,852 | 4/1990 | Tomlinson | 123/196 A |
| 4,951,784 | 8/1990 | Bedi | 123/196 R |
| 5,018,491 | 5/1991 | Fish | 123/196 A |

*Primary Examiner*—E. Rollins Cross
*Assistant Examiner*—Erick Solis
*Attorney, Agent, or Firm*—Watts, Hoffmann, Fisher & Heinke Co.

[57] ABSTRACT

An internal combustion engine oil change system including an oil filter equipped with a check valve fill fitting. During an oil change, new oil is supplied to the engine through the check valve fitting, thus both filling the filter with oil and back flushing the engine's oil pump. An oil supply mechanism including a tank adapted to hold an appropriate pre-measured quantity of oil under air pressure is provided. A flexible hose with a quick disconnect female coupling connects the tank to the filter fitting for delivering oil from the tank through the filter into the engine.

8 Claims, 3 Drawing Sheets

OIL CHANGE SYSTEM AND METHOD

TECHNICAL FIELD

This invention relates to oil filters and more specifically, to an internal combustion engine oil change system and method.

BACKGROUND

For a number of years, all automobile engines and virtually all, if not all internal combustion engines for other applications have been equipped with oil filters. These filters have a finite useful lives and must be changed from time to time to avoid excessive contamination of lubricating oil with an engine. Typically, the spent filter is replaced concurrently with an engine oil change.

When motor oil filters were first introduced, they were typically positioned with the inlet and outlet of the filter oriented upwardly. Such early filters were connected in oil lines communicating with oil passages in the engines and the engine's crank case or connected to the lower portion of the engine's block with an upward orientation. With such upward orientation, it was possible to fill an oil filter with some of the new oil about to be provided for an engine before the filter was connected to that engine.

With many current-day engines, it is no longer possible to prefill the filter before connection to the engine because the filters are oriented with their inlet and outlet openings facing downwardly. Thus, if one attempts to fill the filter with new oil before connecting it to the engine, the oil will pour out as one attempts to connect the filter to the engine.

When and engine is first started up after an oil change, the engine's oil pump and lubricating passages are substantially free of oil because the old oil has been drained from the engine. As such an engine starts the oil pump must self prime and then its output will flow first to the newly installed filter. Until sufficient oil output has been provided to fill the filter, the engine components requiring lubrication will be starved for lubricating oil. A period of the order of 10 to 20 seconds may elapse before oil under pressure is supplied throughout the engine's lubricating system and the wear parts which require lubrication are receiving adequate lubrication. Considerable engine wear can and does occur during this time.

Modern microprocessor controlled ignition systems exacerbate the problem. With a properly tuned microprocessor controlled ignition system, engine start-up is virtually instantaneous as contrasted with several seconds that would pass before even a well tuned engine of the precomputer controlled era would start. This start-up of oil-starved engines has caused a problem. Specifically, excessive engine damage is occuring because oil starvation is occurring.

Investigation has established that service stations which perform oil and filter change services, particularly those of the so-called ten-minute oil change type, are being forced to replace an excessive number of engines which have been severely damaged or destroyed by lack of adequate lubrication on start-up after an oil change. Indeed this investigation suggests auto dismantlers (once known as junkyards) have found a ready market for used engines in selling them to operators of ten-minute oil change facilities. Moreover, the investigation has also revealed that auto manufacturers are experiencing excessive warranty claims.

SUMMARY OF THE INVENTION

A new oil filter embodying the present invention minimizes damage from "cold start-ups" associated with oil change operations. The new oil filter is a typical oil filter available on the market but has a threaded, removable, loading fitting for pumping oil into the filter in order to fill it quickly with an "oil gun." The fitting is threaded into a loading opening located at a closed end of the oil filter opposite a mounting end.

The oil filter is filled with new oil as part of the oil change operation through the loading fitting. The oil which overflows from the filter during "fill-up" backflows through the engine's oil pump, thereby priming the pump, and then through the pump's screen to effect back flushing. This overflow oil then enters and engine crankcase to provide the requisite lubrication to the engine's moving parts. A further advantage of this system is that the oil is filtered before it enters the engine to assure no contaminants are introduced to the engine's lubrication system as can be the case with conventional procedures.

The loading fitting is removed from the used filter when changing oil filters and is mounted in the loading opening on a new oil filter. Alternatively, the oil filters can be manufactured with the loading fitting permanently mounted on each oil fiter thereby allowing the filters to be replaced without moving the loading fitting from the used filter to the new filter.

In order to facilitate the supplying oil to an engine through the filter of this invention an "oil gun" suitable for use in small service stations and by do-it-yourselfers is provided. The oil gun has a small tank capable of holding up to eight quarts of oil. After an amount of oil appropriate for the change being made is put in the tank, a fill cap is closed and sealed and air pressure is supplied to the tank. A flexible hose having a quick disconnect female fitting at its end is then connected to the fitting on the filter. A valve is opened and oil is forced by the air pressure from the supply tank through the filter into the engine.

With larger engines, such as those used in over-the-highway trucks and tractors, the addition of new oil exclusively through the filter may consume an excessive amount of time. Accordingly, one may add some of the new oil conventionally while the balance is supplied through the filter.

PREFERRED MODE OF THE INVENTION

Figure 1:
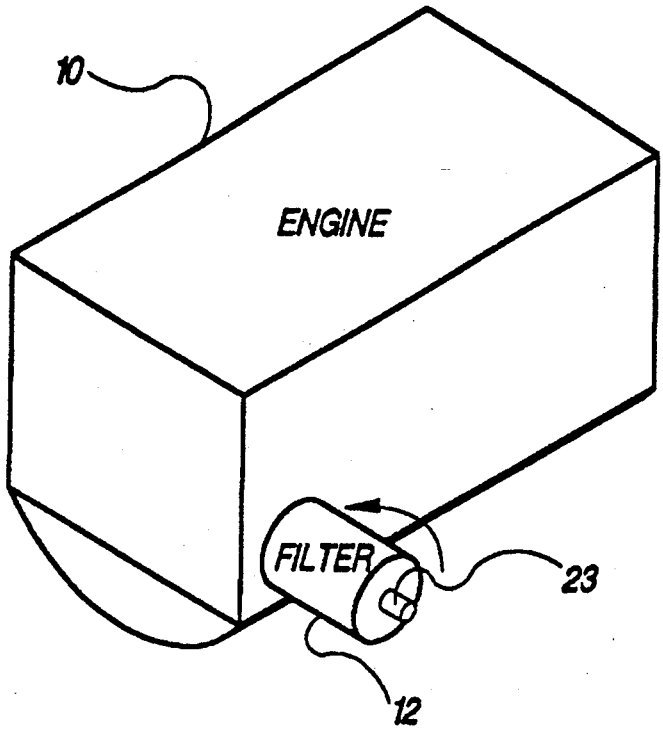
FIG. 1 is a fragmentary schematic view of an engine equipped to the filter of this invention.
Figure 2:
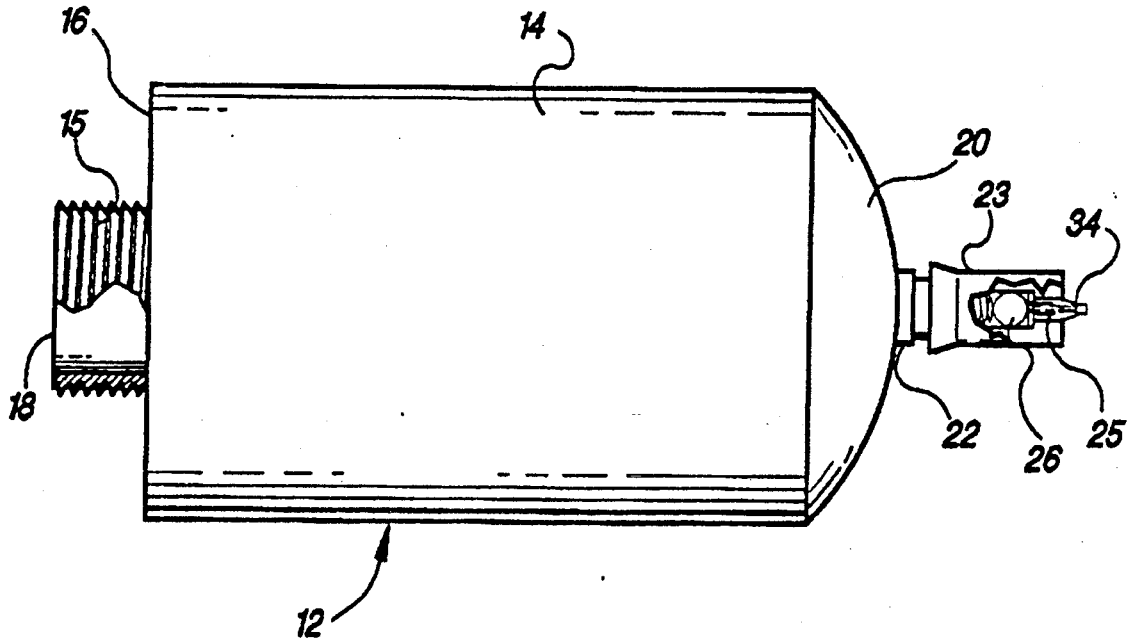
FIG. 2 is a side elevational view on an enlarged scale with respect to FIG. 1 of the filter of this invention.
Figure 3:
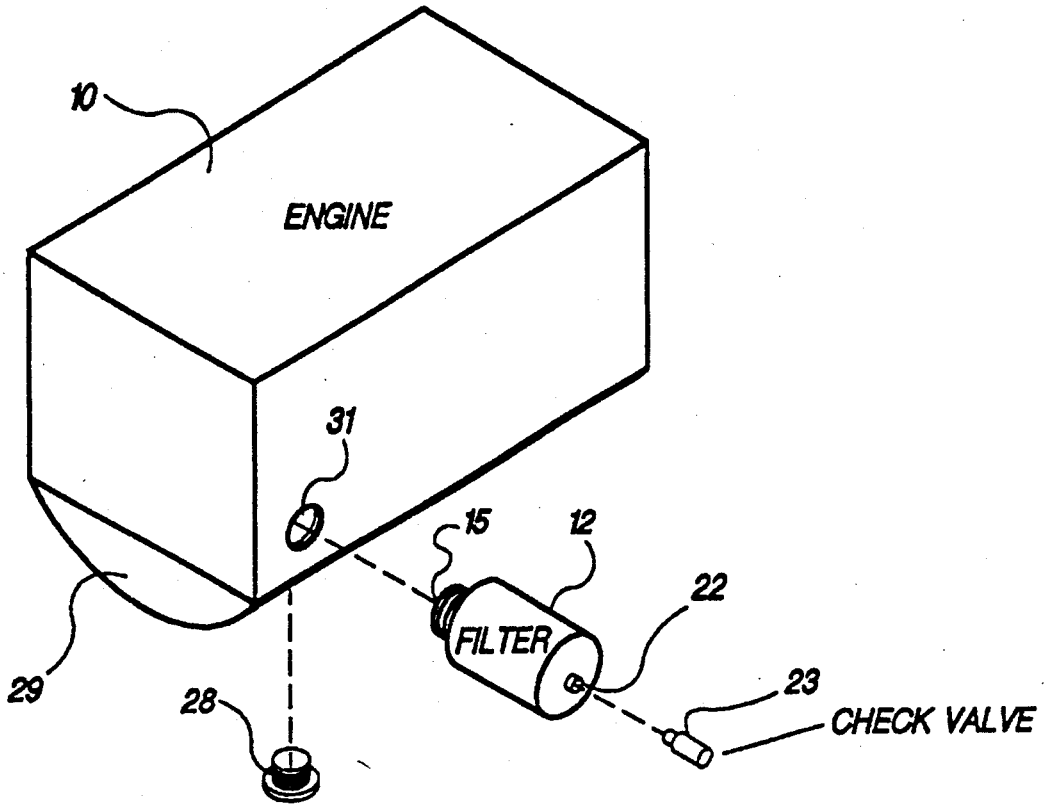
FIG. 3 is a schematic view corresponding to FIG. 1 showing the filter removed from the engine and the drain plug removed from the engine's oil pan.
Figure 4:
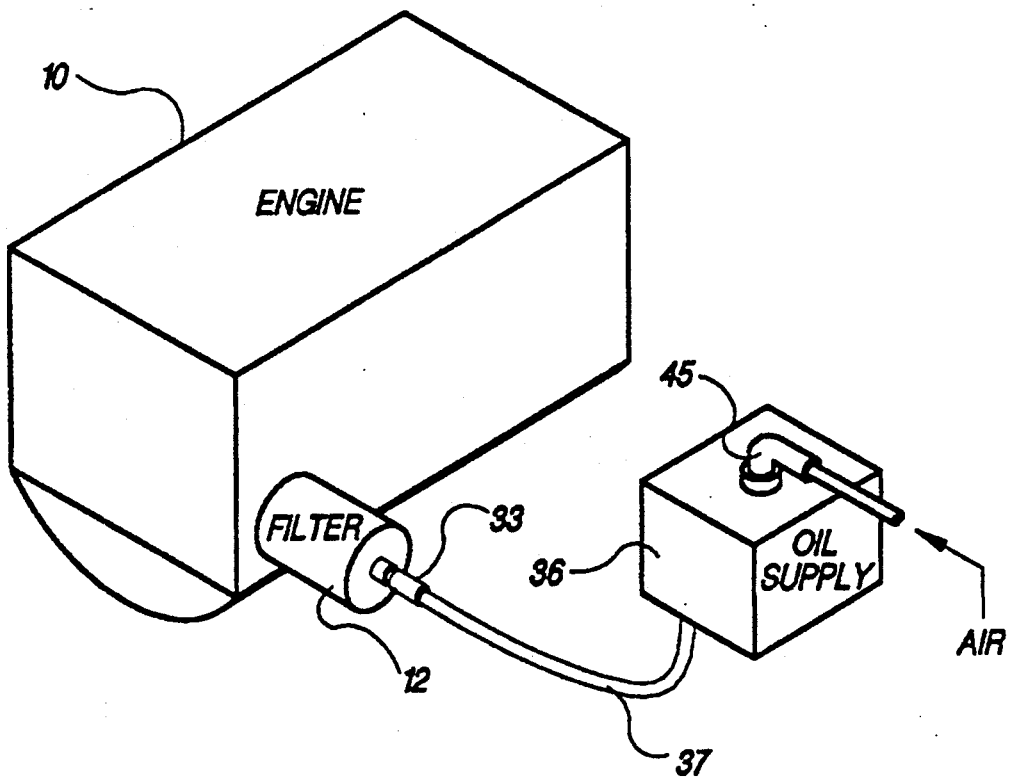
FIG. 4 is a schematic view of the engine corresponding to FIG. 1 showing oil being added to an engine after old oil has been drained.

Referring now to the drawings, an engine is shown schematically at 10 in FIGS. 1, 3 and 4. The engine 10 is equipped with a filter 12 which is the filter of this invention. Referring to FIG. 2, the filter 12 includes a cylindrical housing section 14. A tabular and threaded mounting element 15 is provided at a mounting end 16 of the filter 12. The mounting element 15 is tubular having a through-passage 18 which functions to access both the filter's oil inlet and its outlet when the filter is in use.

The filter 12 includes a dome-like closure 20 at the end of the filter remote from the mounting end 16. The closure 20 is imperforate except for a tapped fitting receiving element 22. A fill fitting 23 is threadably connected to the fitting receiving element 22. The fill fitting 23 includes an inlet passage 25 normally closed by a spring biased ball 26. In short, the fill fitting includes a check valve which permits oil to be introduced through the fitting.

FIG. 3 schematically depicts the process of changing both oil within the engine and the filter. To that end, a drain plug 28 has been removed from an oil pan 29 to allow the oil to be drained from the engine. The filter has been removed from the engine by rotating it in the direction indicated by the arrow in FIG. 1 to disconnect the threaded mounting element 15 from a threaded aperture 31 in the engine block.

A check valve 23 has been removed from the filter also by unthreading it. The operator then threadably connects the check valve 23 to a new filter 12 and in turn connects the filter by threading it into the engine aperture 31. The drain plug 28 is reconnected to the engine and the engine is prepared to receive new oil.

A quick disconnect female fitting 33 is connected to an appropriately sized male fitting portion 34 of the fitting 23. Oil is fed from an oil supply 36 through a hose 37 to the quick disconnect female fitting 33.

Figure 5:
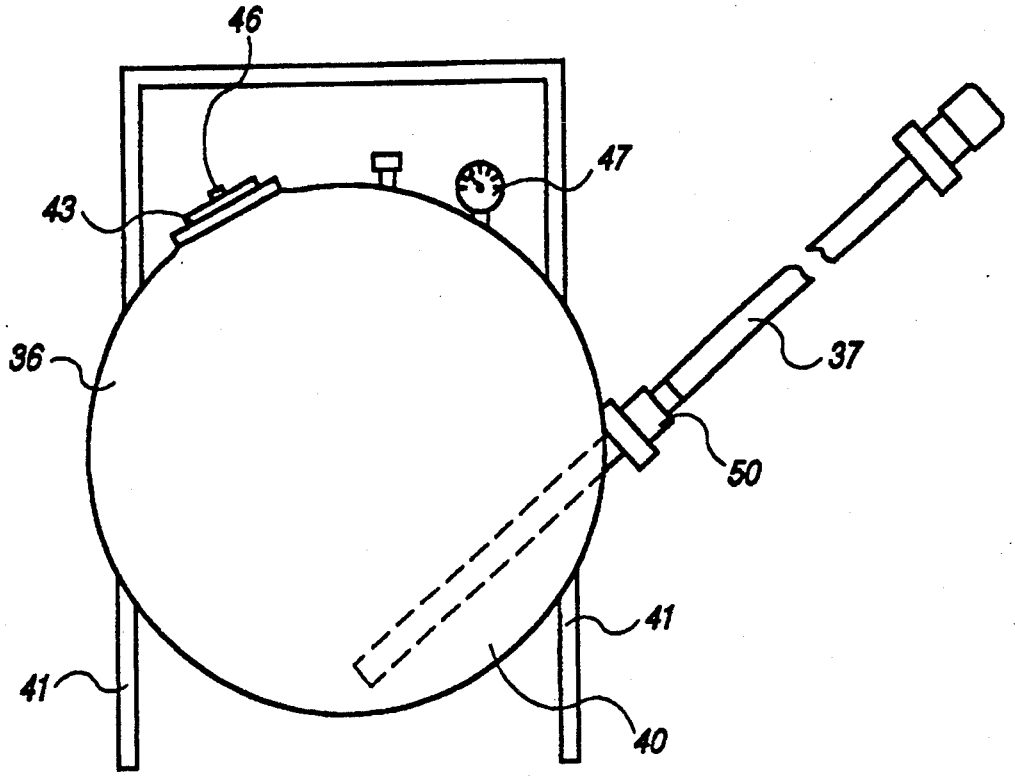
FIG. 5 is a view of an "oil gun" device used to supply new oil to the engine.

An oil supply for do-it-youselfers and small garages is that shown in FIG. 5. Turning to FIG. 5, a tank 40 is provided. The tank 40 is supported by legs 41 for mounting on the floor of a garage of the like. The tank 40 has a fill opening 43 through which a pre-measured quantity of oil may be introduced. Once the fill opening 43 is closed, an air supply indicated schematically at 45 in FIG. 4 is connected to an air fitting 46, FIG. 5. Air is supplied to desired pressure as indicated on an air gauge 47. The quick disconnect female fitting 33 is connected to the filter. A valve 50 is then opened. The air pressure in the tank 40 forces oil through the supply hose 37 then through the filter 12 into the engine. Thus, the oil filter is filled before the engine is started up after an oil change. Moreover, standard internal connections of the engine will cause the oil to enter the crank case and concurrently reverse flush an oil pump. With this system, oil pressure will be supplied to the engine virtually instantaneously after start-up after an oil and filter change.

Figure 6:
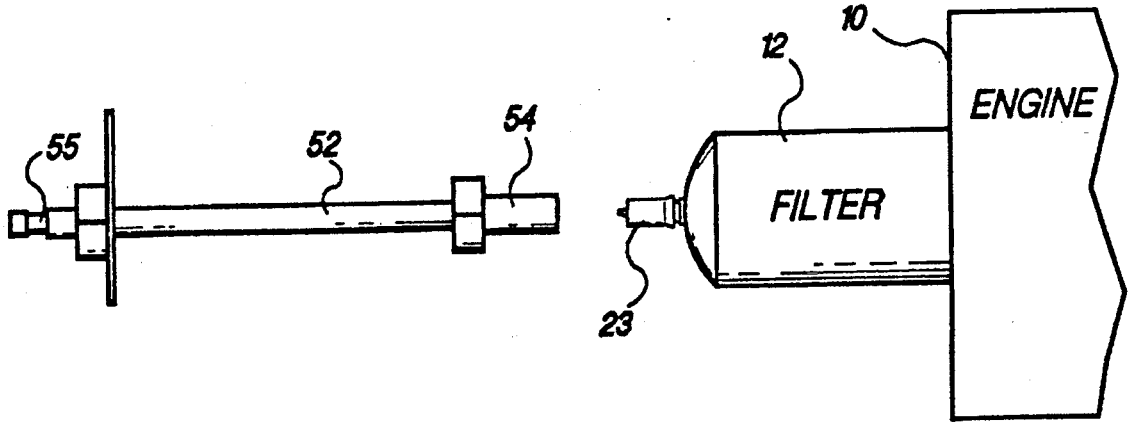
FIG. 6 is a schematic representation of an auxiliary hose for use with filters at hard-to-reach locations.

In some vehicles, access to the fitting 23 will be difficult to achieve because of the positioning of the filter 12 relative to other vehicle components. In that event, it may be desirable to install an auxiliary hose 52 as shown in FIG. 6. The hose may be mounted, for example, on a fender well with an outlet female fitting 54 positioned in proximity to the fitting 23. In certain installations, it may be desirable to have the male fitting portion 34, other than coaxial with, the mounting Element 15 such as by providing a 90° or 45° elbow. When new oil is to be added, the female fitting 54 is connected to the filter fitting 23 while the female fitting 33 connected to the hose 37 is connected to a male fitting 55 at the end of the auxiliary hose 52 remote from the female fitting 54 and the filter 12. The male fitting 55 can be, if desired, permanently mounted to the fender well, as we have indicated. In that event, the fitting 55 will be positioned for easy and ready access.

Although one embodiment of the present invention has been illustrated and described, the present invention is not to be considered limited to the precise embodiment disclosed. Various adaptations, modifications and uses of the invention may occur to those skilled in the art to which the invention relates and the intention is to cover all such adaptations, modifications and uses which fall within the spirit or scope of the appended claims.

I claim:

1. An internal combustion engine oil filtering device comprising:

a) a tabular housing having spaced closed and mounting ends;

b) the mounting end including a mounting surface for mounting the filtering device to an engine;

c) the mounting end including inlet and outlet openings and being otherwise imperforate;

d) the openings being for communication with an engine's lubrication system;

e) a filter located within the housing;

f) the closed end including a loading opening and being otherwise imperforate;

g) a loading fitting connected to the housing in fluid communication with the loading opening, the loading fitting being adapted to receive lubrication oil for filling said device and supplying oil to a connected engine; and, h) said fitting including a check valve means for preventing oil from exiting said device.

2. The filtering device of claim 1 wherein said loading fitting is adapted to be removably received into said loading opening via screw-type threads located on both the loading fitting and the loading opening to enable the loading fitting to be transferable to a new filtering device.

3. A disposable oil filter comprising:

a) a tubular housing;

b) a mounting surface for mounting the filter to an engine for filtering the engine's oil;

c) a plurality of inlet holes arranged circularly and located within the mounting surface;

d) an outlet hole located centrally among the inlet holes;

e) a filter located within the housing;

f) a threaded loading opening; and, g) a removable, threaded loading fitting including a check valve means for being received within the loading opening, the fitting being adapted to receive oil for filling the filter while preventing oil from exiting the filter.

4. An oil filter comprising:

a) a tubular housing;

b) a mounting surface for mounting the filter to an engine for filtering the engine's oil;

c) a plurality of inlet holes arranged circularly and located within the mounting surface;

d) and outlet hole located centrally among the inlet holes;

e) a filter located within the housing;

f) a loading opening;

g) a loading fitting connected to the housing in fluid communication with the loading opening, the loading fitting being adapted to receive oil for filling the filter and an engine crankcase; and, h) the fitting including a check valve means for preventing oil from exiting the filter.

5. A method of changing and engine's used oil comprising:

a) draining all used oil from an engine;

b) removing a used oil filter;

c) mounting a new oil filter in place of the used oil filter;

d) filling the new oil filter and supplying new oil to the crank case by supplying the new oil to the filter and crankcase by flowing oil through a check valve equipped fitting connected to the new filter.

6. A method of changing an engine's used oil comprising:

a) draining all used oil from an engine;

b) removing a used oil filter;

c) removing a threaded check valve equipped fitting from a threaded loading opening located on the used filter;

d) mounting a new oil filter in place of the used filter;

e) mounting the fitting into a threaded loading opening located on the new oil filter;

f) filling the new oil filter with new oil via the fitting.

7. The method of claim 6 including the step of continuing to flow oil via the fitting after the filter has been filled until the engine has an appropriate quantity of new oil.

8. The method of claim 6 including the steps of connecting an oil supply mechanism to the fitting, placing a pre-measured quantity of new oil in the mechanism; and pressurizing the mechanism to force the new oil into the filter and the engine.

* * * * *